US007126547B2

(12) United States Patent
Kim et al.

(10) Patent No.: US 7,126,547 B2
(45) Date of Patent: Oct. 24, 2006

(54) ANTENNA MODULE AND ELECTRONIC APPARATUS HAVING THE SAME

(75) Inventors: Hyun Hak Kim, Kyungki-do (KR); Chul Ho Kim, Kyungki-do (KR); Jeong Sik Seo, Daejeon (KR); Il Hwan Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 29 days.

(21) Appl. No.: 10/983,634

(22) Filed: Nov. 9, 2004

(65) Prior Publication Data

US 2006/0049988 A1 Mar. 9, 2006

(30) Foreign Application Priority Data

Sep. 6, 2004 (KR) ..... 10-2004-0070767

(51) Int. Cl.
*H01Q 1/24* (2006.01)

(52) U.S. Cl. ..... 343/702; 343/700 MS

(58) Field of Classification Search ..... 343/702, 343/700 MS, 873, 90.6; 455/90, 90.3
See application file for complete search history.

(56) References Cited

U.S. PATENT DOCUMENTS

| | | | | |
|---|---|---|---|---|
| 5,438,305 | A * | 8/1995 | Hikita et al. | 333/32 |
| 5,861,854 | A * | 1/1999 | Kawahata et al. | 343/702 |
| 5,907,817 | A | 5/1999 | Mendolia | |
| 6,552,686 | B1 | 4/2003 | Ollikainen et al. | |
| 6,642,892 | B1 * | 11/2003 | Masaki et al. | 343/702 |
| 6,778,139 | B1 | 8/2004 | Suzuki et al. | |
| 6,992,627 | B1 * | 1/2006 | Honda et al. | 343/702 |
| 2003/0030586 | A1 | 2/2003 | Suszuki et al. | |

FOREIGN PATENT DOCUMENTS

| | | |
|---|---|---|
| EP | 1 271 690 | 1/2003 |
| FR | 2 748 161 | 10/1997 |
| GB | 2 387 486 | 10/2003 |
| JP | 9-205314 | 8/1997 |
| JP | 2003-087022 | 3/2003 |
| WO | 02/078123 | 10/2002 |

* cited by examiner

*Primary Examiner*—Hoanganh Le
(74) *Attorney, Agent, or Firm*—Lowe Hauptman & Berner, LLP.

(57) ABSTRACT

An antenna module, which minimizes a space, in an electronic apparatus set, occupied thereby without changing characteristics thereof, improves a degree of freedom of the installation structure thereof to increase the space utilization of the set, and achieves miniaturization and multi-functionality of electronic apparatuses, and an electronic apparatus having the antenna module. The antenna module includes a PCB (printed circuit board) made of nonconductive material having flexibility; an antenna element mounted at a designated position of the upper surface of the PCB; a ground line formed on the PCB so that the ground line is connected to a ground terminal of the antenna element, and provided with a joint portion formed at one end thereof; a feeder line formed on the PCB so that the feeder line is connected to a signal terminal of the antenna element, and provided with a joint portion formed at one end thereof; and a passive line, having a designated length, formed on the PCB in parallel with the feeder line. The joint portions of the ground line and the feeder line are bonded to designated positions of a set of the wireless electronic apparatus, and a portion of the antenna module having the antenna element mounted on the PCB is located outside the set.

8 Claims, 6 Drawing Sheets

ANTENNA MODULE AND ELECTRONIC APPARATUS HAVING THE SAME

RELATED INVENTION

The present application is based on, and claims priority from, Korean Application Number 2004-70767, filed Sep. 6, 2004, the disclosure of which is incorporated by reference herein in its entirety.

BACKGROUND OF THE INVENTION

1. Field of the Invention

The present invention relates to an antenna module installed on an electronic apparatus having a wireless communication function, and more particularly to an antenna module, which minimizes a space, in an electronic apparatus set, occupied thereby, improves a degree of freedom of the installation structure thereof to increase the space utilization of the set, and achieves miniaturization and multi-functionality of electronic apparatuses, and an electronic apparatus having the antenna module.

2. Description of the Related Art

In order to meet the recent development of semiconductor and communication technique, electronic apparatuses having a wireless communication function for improving mobility and portability thereof by users (hereinafter, referred to "wireless electronic apparatuses") have generally been used. A cellular phone is a good example of a wireless electronic apparatus. In order to satisfy user's requirements to the portability, wireless electronic apparatuses have been gradually developed into increasingly light-weight and miniature devices.

Further, in order to satisfy user's requirements to the convenience in possession so that a single apparatus has at least two functions, the wireless electronic apparatuses have been multi-functionalized so as to include at least one function selected from MP3, camera, credit card, and wireless contact-type traffic card functions.

Accordingly, the miniaturization of components of the wireless electronic apparatuses has been researched. The above research is applied to an antenna for transmitting and receiving wireless signals. The conventional wireless electronic apparatuses generally use internal antennas so as to reduce the size of products. The internal antennas include a microstrip patch antenna, a flat inverted F-type antenna, and a chip antenna.

The microstrip patch antenna is embodied by a microstrip patch printed on a printed circuit board. In the chip antenna, multi-layered radiation patterns having various shapes including a spiral shape are formed in a dielectric block, and are electrically connected, thereby functioning as an antenna having a route of current corresponding to a designated frequency.

As shown in FIG. 1, an inverted F-type antenna comprises a radiation patch 11 formed at a designated height from the upper surface of a PCB (printed circuit board) 10, a feeder line 12, for applying current, and a ground line 13, which are connected to one edge of the radiation patch 11. The feeder line 12 and the ground line 13 are perpendicular to the radiation patch 11, and bonded to signal and ground patterns on the PCB 10.

The radiation patch 11 may have a rectangular shape. In FIG. 1, in order to expand a transmitting and receiving band and improve antenna characteristics, the radiation patch 11 on a rectangular conductive plane is divided into slits having designated shapes, thereby being deformed to a spiral shape.

The radiation patch 11 may be deformed into various shapes. In the inverted F-type antenna of FIG. 1, the radiation patch 11 has two current routes, and receives and transmits frequency signals having wavelengths corresponding to electric lengths of the two current routes.

Here, the feeder and ground lines 12 and 13 of the radiation patch 11 may be supported by a designated dielectric, for example, a ceramic block.

As shown in FIG. 1, the above-described conventional internal antenna requires a peripheral space having a designated size or more, which is not grounded, in order to maintain characteristics thereof, when the internal type antenna is mounted on a wireless electronic apparatus set 10. Accordingly, the conventional internal antenna occupies a space, on the wireless electronic apparatus set, having a size larger than that of the antenna. It is difficult to prepare the corresponding space on wireless electronic apparatuses, which require miniaturization and multi-functionality. If it is possible to decrease the above space, the wireless electronic apparatus can be further miniaturized. Accordingly, it is necessary to decrease the space for installation of the antenna on the wireless electronic apparatus.

Japanese Patent Laid-open No. 2003-87022 discloses an antenna module having a high mounting density. FIG. 2 is a perspective view of the antenna module disclosed by the above Patent. With reference to FIG. 2, the antenna module comprises an antenna element 22, a driving circuit 23 for supplying current to the antenna element 22, and a waveguide 24 extended from one side surface of a PCB 21, on which the driving circuit 23 is installed, for connecting the driving circuit 23 and the antenna element 22. Here, the waveguide 24 is formed on a hard member having flexibility, and is bent so that the antenna element 22 can be three-dimensionally disposed on the PCB 21. In the antenna module having the above constitution, the antenna element 22, the waveguide 24, and the PCB 21 are integrally formed, thereby reducing the number of steps of an assembly process and achieving freedom of disposing wires or components.

When the waveguide 24 is vertically folded to be installed in a wireless electronic apparatus after the above antenna module is manufactured, the impedance of the waveguide 24 of the antenna module is changed, thereby causing signal loss and deteriorating characteristics of the antenna module.

Therefore, there has been developed an antenna module, which requires a small installation space on an electronic apparatus set and has a high freedom of disposition without changing characteristics thereof.

SUMMARY OF THE INVENTION

Therefore, the present invention has been made in view of the above problems, and it is an object of the present invention to provide an antenna module, which minimizes a space, in an electronic apparatus set, occupied thereby without changing characteristics thereof, improves a degree of freedom of the installation structure thereof to increase the space utilization of the set, and achieves miniaturization and multi-functionality of electronic apparatuses, and an electronic apparatus having the antenna module.

In accordance with one aspect of the present invention, the above and other objects can be accomplished by the provision of an antenna module comprising: a PCB (printed circuit board) made of nonconductive material having flexibility; an antenna element mounted at a designated position of the upper surface of the PCB; a ground line formed on the PCB so that the ground line is connected to a ground terminal of the antenna element, and provided with a joint portion formed at one end thereof; a feeder line formed on the PCB so that the feeder line is connected to a signal terminal of the antenna element, and provided with a joint portion formed at one end thereof; and a passive line, having a designated length, formed on the PCB in parallel with the feeder line.

The antenna module may further comprise a fixing board made of nonconductive material having a designated degree of hardness, and attached to the lower surface of the PCB, on which the antenna element is mounted, for supporting the antenna element.

Preferably, the PCB may have a single-layered structure made of one selected from the group consisting of reversible material, including polymer and flexible metal, and irreversible material, including polyimide, polyester, and glass epoxy, or a multi-layered structure including a plurality of sheets made of one or more selected from the above group and attached by an organic bonding agent.

Further, preferably, the antenna element may be mounted on the upper surface of the PCB by a die-bonding method. More preferably, the antenna element may include a stacked ceramic chip antenna or an inverted F-type antenna.

In accordance with another aspect of the present invention, there is provided a wireless electronic apparatus comprising: a set of a plurality of elements constituting a designated circuit; and an antenna module including: a PCB (printed circuit board) made of material having flexibility; an antenna element mounted at a designated position of the upper surface of the PCB; a ground line formed on the PCB so that the ground line is connected to a ground terminal of the antenna element, and provided with a joint portion formed at one end thereof; a feeder line formed on the PCB so that the feeder line is connected to a signal terminal of the antenna element, and provided with a joint portion formed at one end thereof; and a passive line formed on the PCB in parallel with the feeder line, wherein the joint portions of the ground line and the feeder line are bonded to designated positions of the set, and a portion of the antenna module having the antenna element mounted on the PCB is located outside the set.

Preferably, the joint portions of the ground line and the feeder line may be connected to an outer edge of the upper surface of the set. Here, a sidewall having a designated size may be formed at the side surface of the set; and the portion of the antenna module having the antenna element is placed, may be attached to the sidewall.

Further, preferably, a side wall in a designated size, including a protruded fixing pin, may be formed at the side surface of the set; a fixing hole may be formed at a position of the antenna module corresponding to the fixing pin; and the antenna module may be fixed to the side wall by inserting the fixing pin into the fixing hole.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 3:
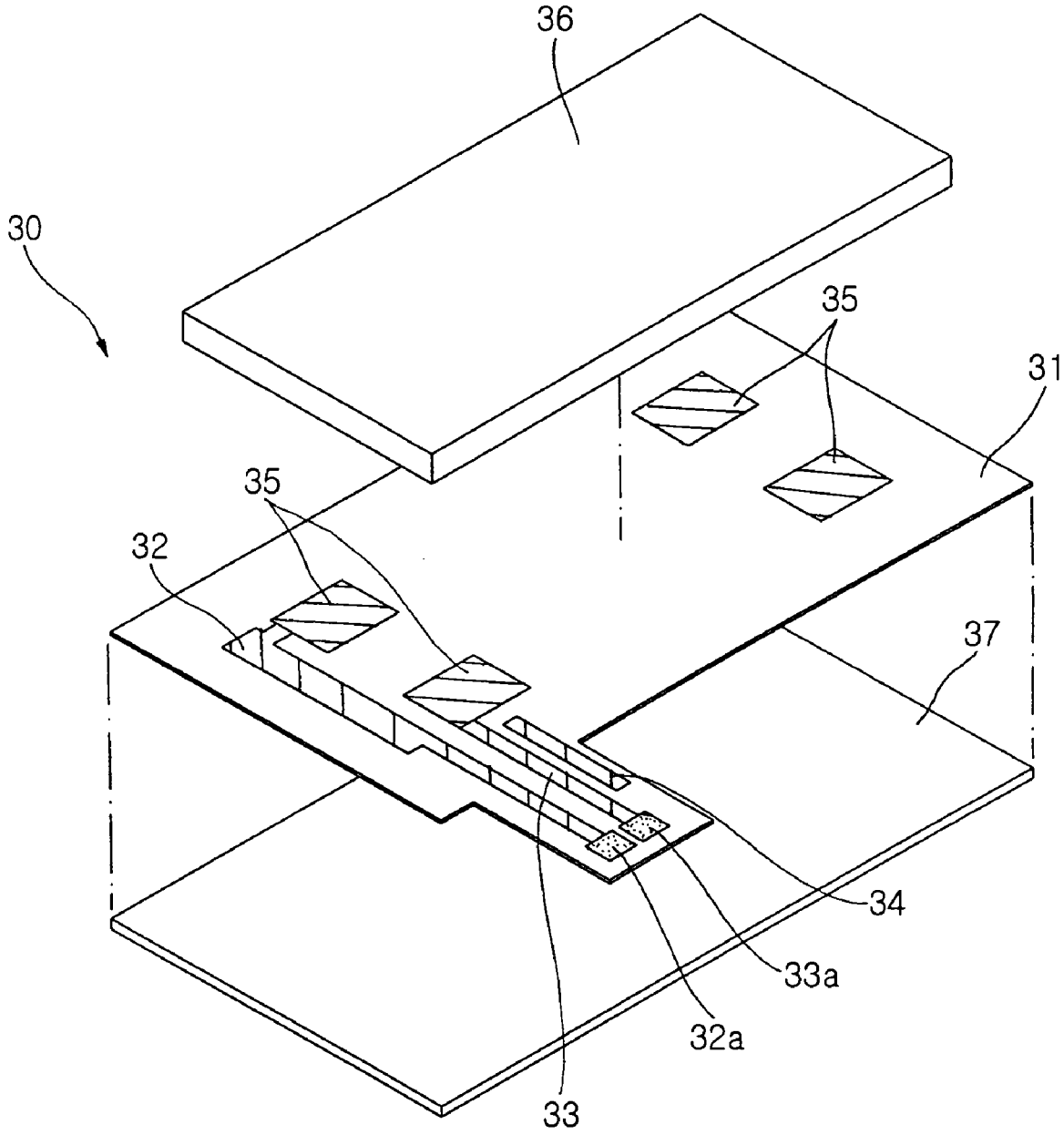
FIG. 3 is an exploded perspective view illustrating the overall constitution of an antenna module in accordance with the present invention.

FIG. 3 is an exploded perspective view illustrating the overall constitution of an antenna module in accordance with the present invention.

With reference to FIG. 3, the antenna module 30 of the present invention comprises a PCB (printed circuit board) 31 made of nonconductive material having flexibility, a ground line 32 formed on the PCB 31 and made of conductive material for grounding an antenna element 36, a feeder line 33 formed at a designated position of the PCB 31 and made of conductive material for supplying current to the antenna element 36, a passive line 34 formed in parallel with the feeder line 33 and not connected to a ground or signal terminal for adjusting impedance by the electric coupling with the feeder line 33, a plurality of bonding pads 35 formed at a position, for mounting the antenna element 36, of the PCB 31 and connected the ground line 32 or the feeder line 33, the antenna element 36 mounted at the designated position of the upper surface of the PCB 31 using the bonding pads 35 so that the ground terminal and the signal terminal of the antenna element 36 respectively contact sides of the ground line 32 and the feeder line 33, and a fixing board 37 attached to the lower surface of the PCB 31, on which the antenna element 36 is mounted, and made of nonconductive material having a designated degree of hardness for supporting the antenna element 36.

The above-described antenna module 30 is installed on the external surface of a wireless electronic apparatus set such that only the feeder line 33 of the antenna module 30 is mounted on the set, thereby decreasing the size of an installation space in the set. Further, the antenna module 30 is foldable without distortion of impedance matching, thereby maintaining characteristics thereof and improving a degree of freedom of disposition when the antenna module 30 is mounted on the wireless electronic apparatus set.

For this reason, the PCB 31, on which the lines 32 to 34, for inputting and outputting signals to and from the antenna element 36, grounding, and impedance-matching, are formed, is flexible and nonconductive, thereby improving a degree of freedom of disposition thereof outside the wireless electronic apparatus set.

That is, since the PCB 31 is freely foldable or bendable, the PCB 31 is bent and placed on the upper or side surface of the wireless electronic apparatus set. Here, the antenna module 30 may further comprise an additional fixing member for fixing the radiation direction of the antenna element 36. The fixing member will be described later with reference to another embodiment of the present invention.

In order to obtain flexibility, the PCB 31 is made of reversible material, such as polymer or flexible metal, or irreversible material, such as polyimide, polyester, or glass epoxy. The PCB 31 may be a single-layered PCB made of one selected from the above group, or a multi-layered PCB including a plurality of sheets made of one or more selected from the above group and attached by an organic bonding agent.

Subsequently, the ground line 32 and the feeder line 33, formed on the PCB 31, are respectively connected to the bonding pads 35 formed at the positions for installing the antenna element 36, and contact the ground and signal terminals formed on the antenna element 36. Joint portions 32*a* and 33*a*, for example, made of solder, are formed at ends of the ground line 32 and the feeder line 33, thereby mounting the antenna module 30 on the wireless electronic apparatus set.

In addition to the ground line 32 and the feeder line 33, the antenna module 30 of the present invention further comprises the passive line 34 made of conductive material having a designated length in parallel with the feeder line 33.

The passive line 34 is electrically coupled with the feeder line 33, thereby being capable of matching impedance of 50Ω even though the feeder line 33 is folded at a designated angle. That is, impedance matching between the antenna element 36 and the wireless electronic apparatus set is achieved, thereby minimizing signal loss.

Figure 1:
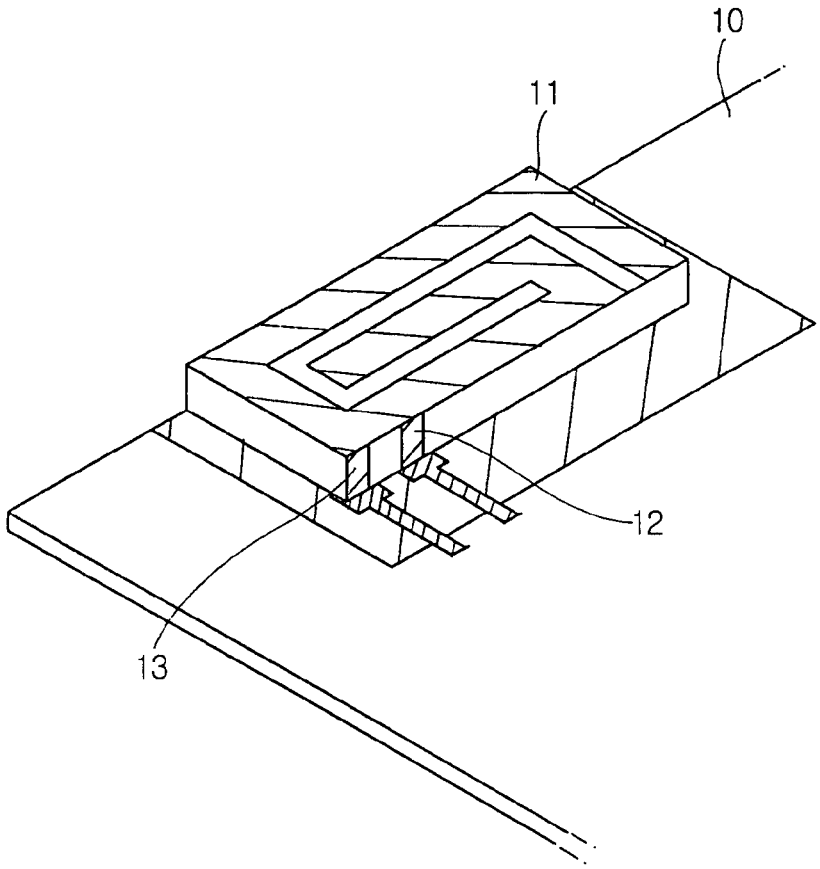
PRIOR ART FIG. 1
FIG. 1 is a perspective view illustrating the structure and installation of a conventional internal antenna.
Figure 2:
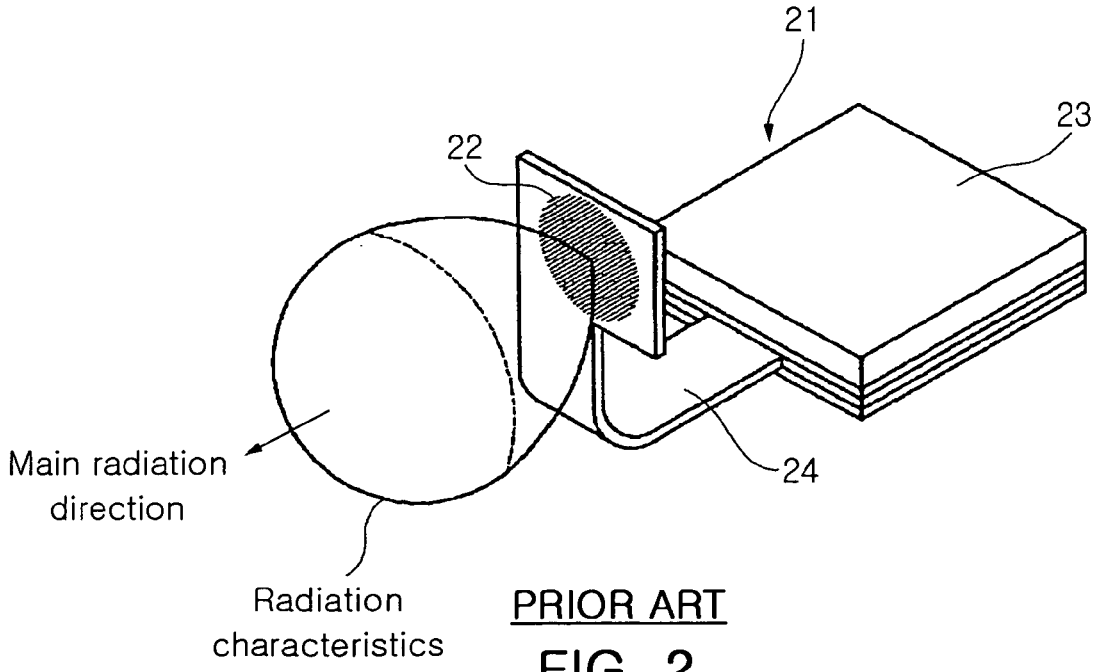
PRIOR ART FIG. 2
FIG. 2 is a perspective view illustrating the structure of another conventional antenna module.

In case that the antenna module does not comprise the passive line 34, since chip antennas, which are manufactured according to frequencies, have different characteristics, feeder lines of the chip antennas are newly designed. Further, in case that the antenna module is vertically erected, as shown in FIG. 2, the feeder line is perpendicularly bent, thereby distorting impedance matching.

On the other hand, in the antenna module 30 comprising the passive line 34, the passive line 34 is electrically coupled with the feeder line 33, and generates coupling capacitance, thereby decreasing the variation in impedance due to the variation of position of the antenna element 36, and achieving transmission of signals without loss. In other words, similarly to the feeding structure of a CPW (co-planar waveguide), it is possible to achieve impedance matching over a broad frequency band.

Figure 4A:
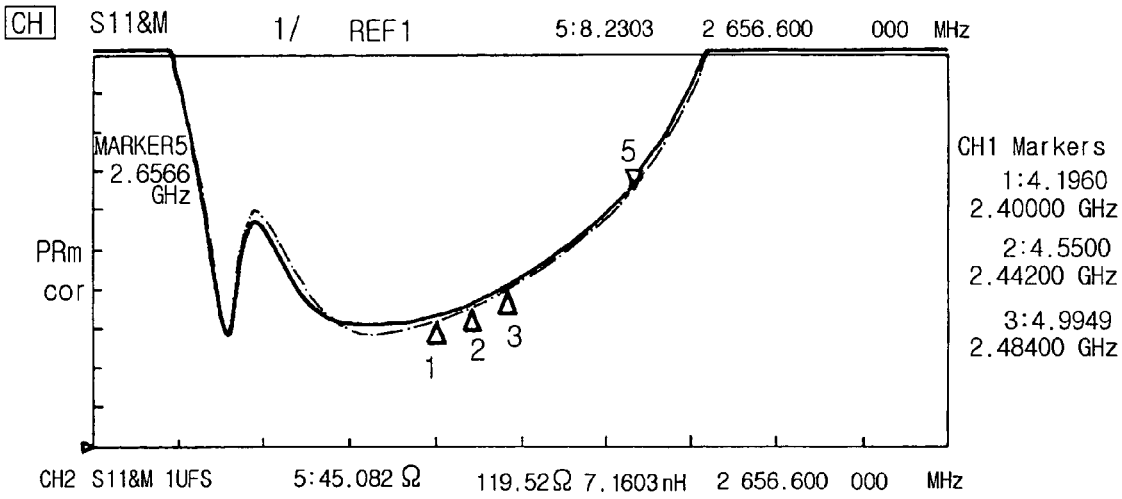
FIGS. 4*a* and 4*b* are graphs illustrating characteristics of the antenna module of the present invention, which does not comprise a passive line.
Figure 4B:
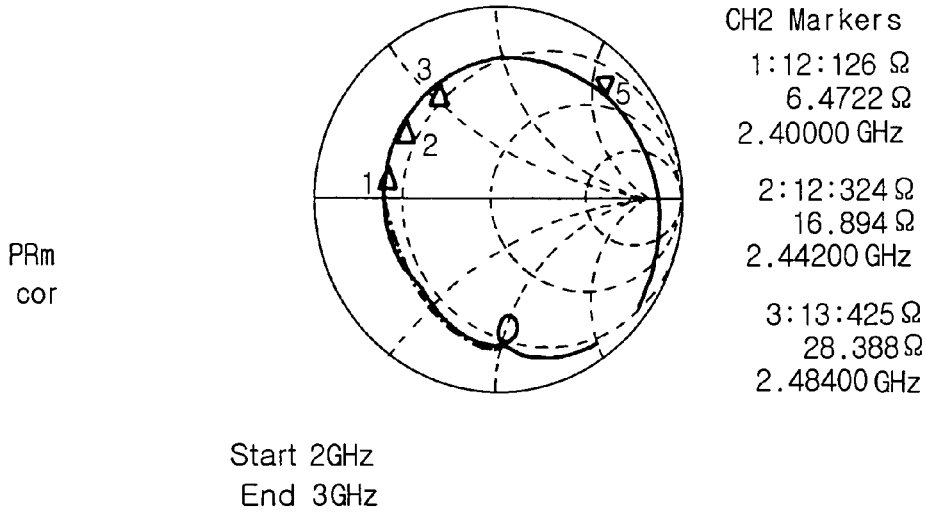
Figure 5A:
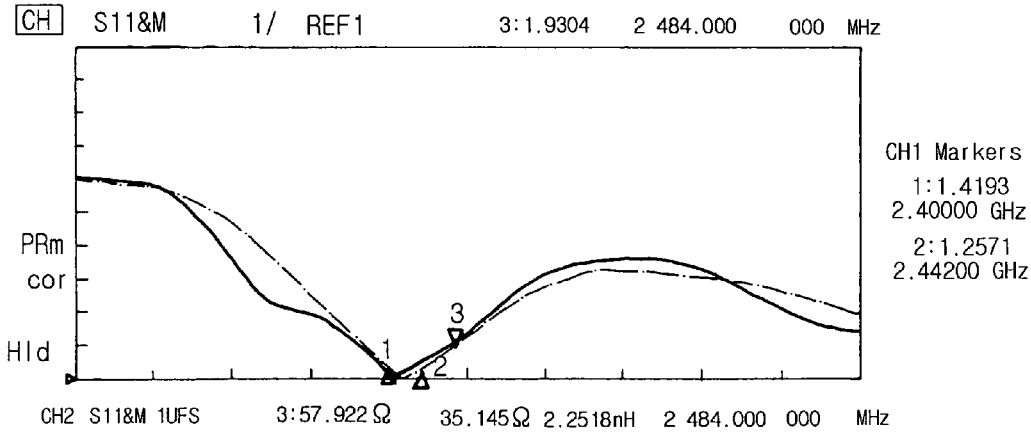
FIGS. 5*a* and 5*b* are graphs illustrating characteristics of the antenna module of the present invention, which comprises a passive line.
Figure 5B:
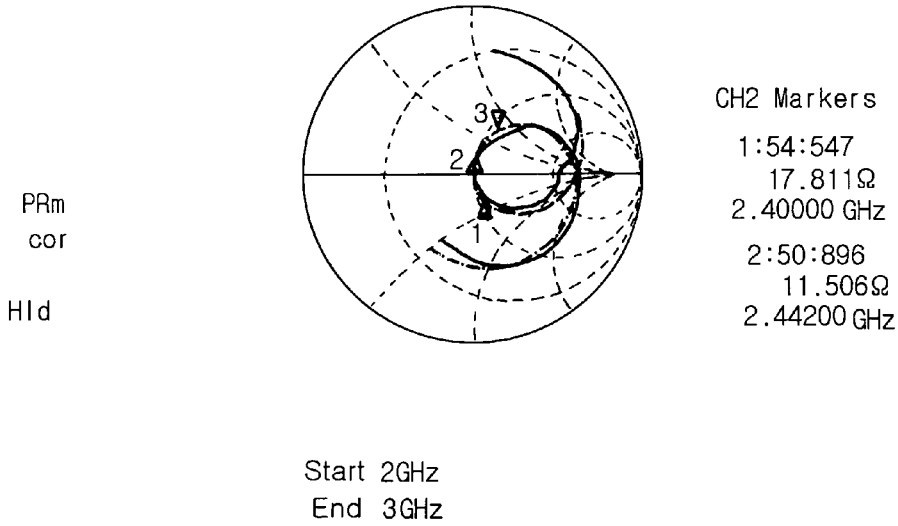

FIGS. 4*a* and 4*b* are graphs illustrating characteristics of the antenna module having a conventional feeding structure, which does not comprise the passive line 34, and FIGS. 5*a* and 5*b* are graphs illustrating characteristics of the antenna module 30 of the present invention, which comprises the passive line 34. The graphs of FIGS. 4*a* and 5*a* respectively illustrate standing-wave ratios, and the graphs of FIGS. 4*b* and 5*b* respectively illustrate radiation characteristics.

Comparing the graphs of FIGS. 4*a* and 4*b* to the graphs of FIGS. 5*a* and 5*b*, it can be seen that the antenna module 30 comprising the passive line 34, as shown in FIGS. 5*a* and 5*b*, has signal loss, lower than that of the antenna module not comprising the passive line 34, as shown in FIGS. 4*a* and 4*b*, over a broader frequency band. That is, the impedance matching is improved by forming the passive line 34 in the antenna module 30.

The antenna element 36 mounted on the PCB 31 may have various types, which are mountable on the upper surface of the PCB 31 by a die-bonding method. For example, preferably, the antenna element 36 may include a chip antenna element having the smallest size, and more particularly, a stacked chip antenna or an inverted F-type chip antenna. More comprehensively, the antenna element 36 may include a flat antenna, which has a microstrip formed on a PCB having a designated size.

In case that the antenna element 36 of the antenna module 30 of the present invention is mounted on the PCB 31 made of flexible material, the antenna element 35 is not completely bonded to the PCB 31 or the bonded antenna element 35 is easily detached from the PCB 31. In order to solve the above problem, the fixing board 37 having a designated degree of hardness is attached to the lower surface of the PCB 31 corresponding to the antenna element 36. The fixing board 37 is made of nonconductive nonmetal material so as not to change the characteristics of the antenna element 36.

Figure 6A:
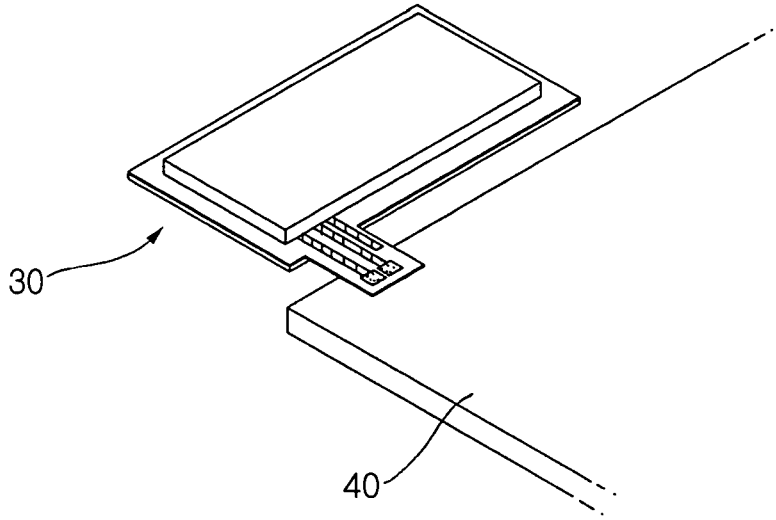
FIGS. 6*a* to 6*c* are perspective views illustrating examples of the installed structure of the antenna module of the present invention on electronic apparatus sets.
Figure 6B:
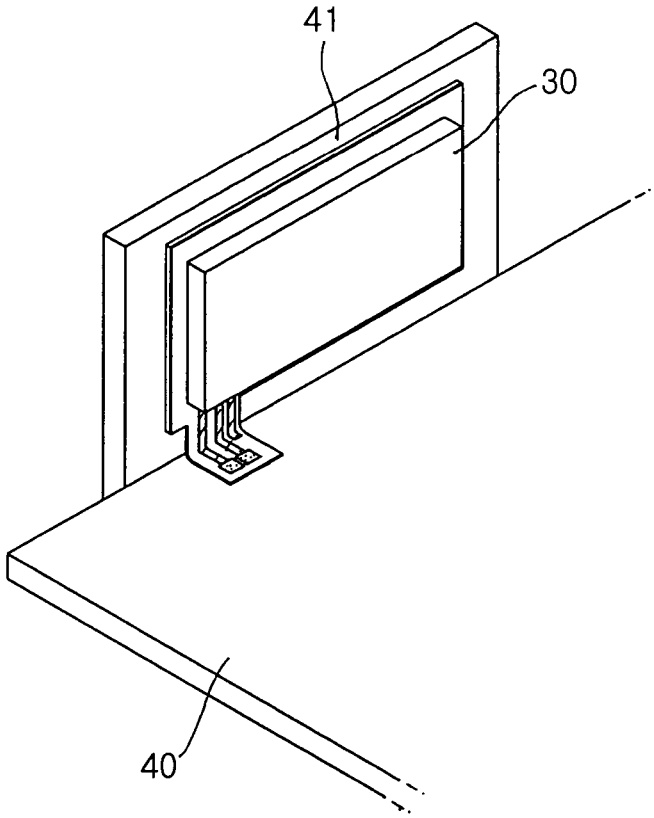
Figure 6C:
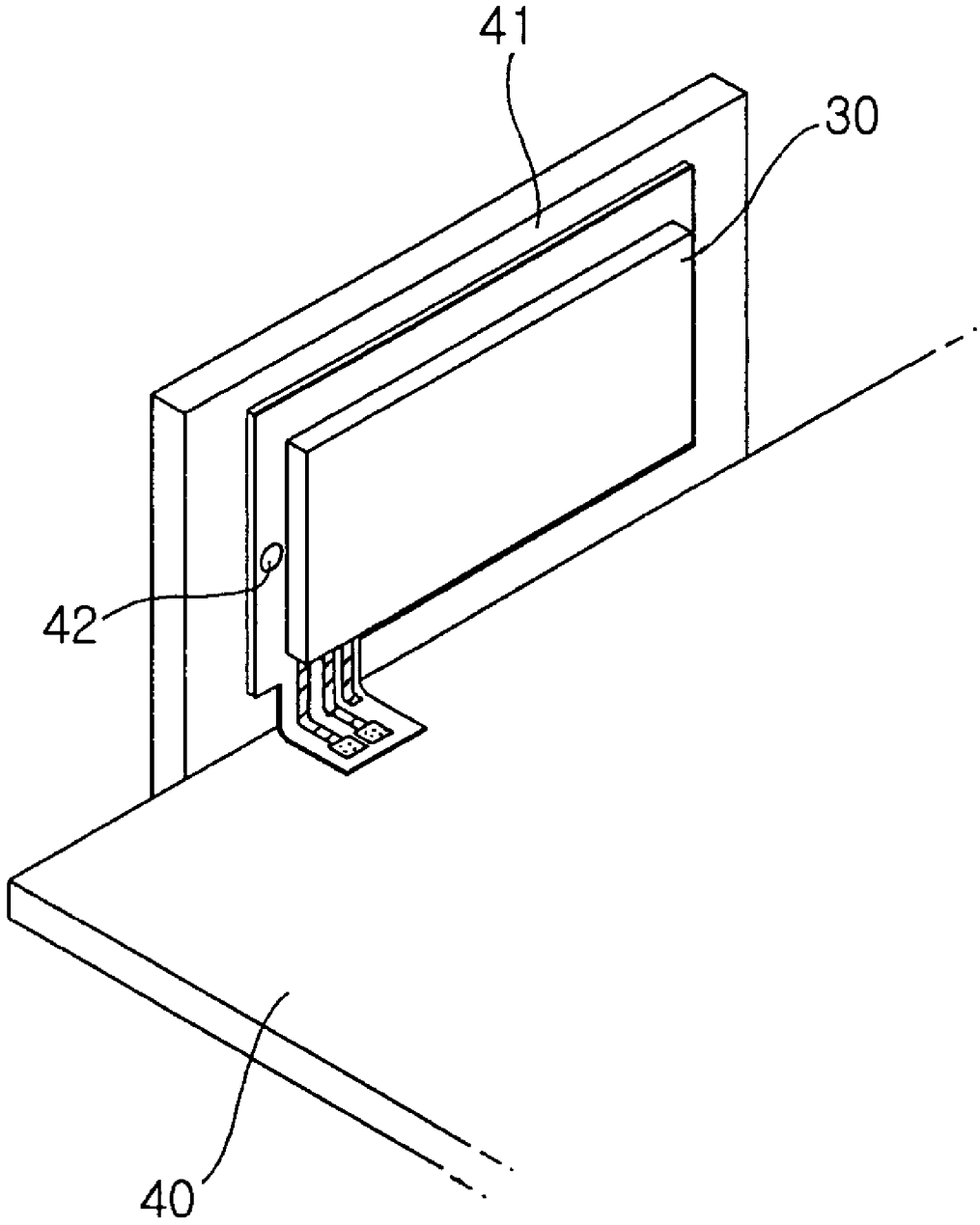

The above antenna module 30 is formed on the external surface of the wireless electronic apparatus set. FIGS. 6*a* to 6*c* are perspective views illustrating examples of the installed structure of the antenna module 30 of the present invention on the wireless electronic apparatus set. Hereinafter, with reference to FIGS. 6*a* to 6*c*, the installation of the antenna module 30 will be described in detail.

With reference to FIG. 6*a*, the joint portions 32*a* and 33*a* of the antenna module 30 are bonded to designated positions of a circuit-printed surface of a wireless electronic apparatus set 40 by soldering. Here, preferably, the bonded positions of the joint portions 32*a* and 33*a* are located on an outer edge of the upper surface of the wireless electronic apparatus set 40. The joint portions 32*a* and 33*a* may be bonded to the upper surface of the wireless electronic apparatus set 40 in any direction of the wireless electronic apparatus set 40. Accordingly, the bonding positions of the joint portions 32*a* and 33*a* to the wireless electronic apparatus set 40 are selected in consideration of the design and direction of use of the wireless electronic apparatus.

The antenna module 30 bonded to the wireless electronic apparatus set 40, as shown in FIG. 6*a*, has flexibility and is folded inwardly, thereby flexibly coping with the structure of a package obtained by packaging the corresponding wireless electronic apparatus.

Here, preferably, the radiation direction of the antenna module 30 faces upward or sideways, rather than toward the wireless electronic apparatus set 40. In order to fix the radiation direction of the antenna module 30, the antenna module 30 is fixed using an additional fixing structure.

FIGS. 6*b* and 6*c* illustrate examples of the fixing structure of the antenna module 30, mounted on the wireless electronic apparatus set 40, in perpendicular to the upper surface of the wireless electronic apparatus set 40.

With reference to FIG. 6*b*, the joint portions 32*a* and 33*a* of the antenna module 30 are connected to the outer edge of the circuit-printed surface of the wireless electronic apparatus set 40 by soldering. Further, a side wall 41, having a designated size, for supporting the antenna module 30 is formed at the side surface of the wireless electronic apparatus set 40, and the surface of the antenna module, on which the antenna element 36 is placed, is attached to the side wall 41 using organic material. Thereby, the main radiation direction of the antenna element 36 faces toward the side surface of the wireless electronic apparatus set 40.

With reference to FIG. 6*c*, the sidewall 41 for supporting the antenna module 30 is also formed at the side surface of the wireless electronic apparatus set 40 in the same manner as FIG. 6*b*. Here, a fixing pin 42 is formed at a designated position of the sidewall 41, and a hole is formed through a position of the PCB 31 corresponding to the fixing pin 42. The fixing pin 42 is inserted into the hole of the PCB 31 of the antenna module 30, thereby fixing the antenna module 30 to the sidewall 41. Here, in the same manner as FIG. 6*b*, the joint portions 32*a* and 33*a* of the antenna module 30 are connected to the outer edge of the circuit-printed surface of the wireless electronic apparatus set 40 by soldering.

In addition to the above examples, the antenna module 30, the joint portions 32*a* and 33*a* of which are connected to the outer edge of the circuit-printed surface of the wireless electronic apparatus set 40, may be received by a reception groove formed in the wireless electronic apparatus set 40.

As described above, in case that the antenna module 30 is placed outside the wireless electronic apparatus set 40, a space, in an electronic apparatus set, occupied by the antenna module 30 is decreased, thereby allowing other components of an electronic apparatus to be easily designed, and solving problems, such as limits in mounted positions of elements influencing characteristics of the antenna module, for example, an LCD, a camera, and a speaker, and a difficulty in maintaining the characteristics of the antenna module.

As apparent from the above description, the present invention provides an antenna module, which is located outside a wireless electronic apparatus set, and an electronic apparatus having the antenna module, thereby minimizing a space, in the electronic apparatus set, occupied thereby, and reducing the effects of elements, located on the wireless electronic apparatus set and influencing characteristics of the antenna module, upon the antenna module.

The antenna module of the present invention comprises a PCB having flexibility, thereby improving a degree of freedom of the installation structure thereof on the wireless electronic apparatus set. Further, the antenna module of the present invention adjusts impedance using a passive line formed in parallel with a feeder line, thereby being disposed on the wireless electronic apparatus set in a perpendicular angle without deteriorating impedance matching.

The antenna module of the present invention mounts only the feeder line and the ground line on the surface of the wireless electronic apparatus set, and places a portion including an antenna element outside the wireless electronic apparatus set in consideration of the package type of the wireless electronic apparatus, thereby satisfying the miniaturization of the wireless electronic apparatus.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An antenna module comprising:

a PCB (printed circuit board) made of a flexible, nonconductive material;

an antenna element mounted on an upper surface of the PCB;

a ground line formed on the PCB so that the ground line is connected to a ground terminal of the antenna element, and provided with a first joint portion at one end thereof;

a feeder line formed on the PCB so that the feeder line is connected to a signal terminal of the antenna element, and provided with a second joint portion at one end thereof, and a non-grounded impedance adjusting passive line, formed on the PCB in parallel with the feeder line, the impedance adjusting passive line being configured to adjust impedance by electric coupling with the feeder line.

2. The antenna module according to claim 1, further comprising a fixing board made of nonconductive material which is attached to a lower surface of the PCB which is opposite the upper surface of the PCB on which the antenna element is mounted.

3. The antenna module according to claim 1, wherein the PCB has a single-layered structure and is made of one of the group consisting of polymer, flexible metal, polyimide, polyester, and glass epoxy, and a multi-layered structure including a plurality of sheets made of one or more selected from the above group and attached by an organic bonding agent.

4. The antenna module as set forth in claim 1, wherein the antenna element is die bonded to the upper surface of the PCB.

5. A wireless electronic apparatus comprising:

a main board having a plurality of elements constituting an electronic circuit of a wireless electronic a apparatus; and an antenna module including:

a PCB (printed circuit board) made of a flexible nonconductive material;

an antenna element mounted on an upper surface of the PCB;

a ground line formed on the PCB so that the ground line is connected to a ground terminal of the antenna element, and provided with a first joint portion at one end thereof;

a feeder line formed on the PCB so that the feeder line is connected to a signal terminal of the antenna element, and provided with a second joint portion at one end thereof; and a non-grounded passive line formed on the PCB in parallel with the feeder line and configured to adjust impedance by electric coupling with the feeder line, wherein the first joint and the second joint portion are each bonded to a ground terminal and a feeder terminal of the main board, and wherein a portion of the PCB mounted on the antenna element is located outside the main board.

6. The wireless electronic apparatus as set forth in claim 5, wherein the first joint portion and the second joint portion are connected to an outer edge of the upper surface of the main board.

7. The wireless electronic apparatus as set forth in claim 6, wherein:

a side wall is formed at a side surface of the main board; and the portion of the antenna module having the antenna element is attached to the sidewall.

8. The wireless electronic apparatus as set forth in claim 6, wherein:

a sidewall including a protruded fixing pin, is formed at the side surface of the main board;

a fixing hole is formed at a position of the antenna module corresponding to the fixing pin; and the antenna module is fixed to the sidewall by inserting the fixing pin into the fixing hole.

* * * * *